US005632693A

United States Patent [19]

Painter

[11] Patent Number: 5,632,693

[45] Date of Patent: May 27, 1997

[54] GOLF CLUB HAVING SELECTIVELY ADJUSTABLE INTERNAL PRESSURE

[76] Inventor: Paul W. Painter, 38850 Town Hall, Mt. Clemens, Mich. 48045

[21] Appl. No.: 554,874

[22] Filed: Nov. 7, 1995

[51] Int. Cl.[6] ..... A63B 53/08

[52] U.S. Cl. ..... 473/318; 473/332

[58] Field of Search ..... 273/80 R, 81 R, 273/170, 167 R, 77 R, 193 R, 194 R, 167 H, 78, 80 B; 473/316–350, 282, 219, 223, 232, 231

[56] References Cited

U.S. PATENT DOCUMENTS

| | | | |
|---|---|---|---|
| 1,568,888 | 1/1926 | Dunn . | |
| 1,831,255 | 11/1931 | Menzies | 273/81 R |
| 1,894,841 | 1/1933 | Adams | 273/170 |
| 2,124,534 | 7/1938 | Barnhart | 273/81 R |
| 3,387,844 | 6/1968 | Shippee . | |
| 3,516,673 | 6/1970 | Estes | 273/80 R |
| 3,817,522 | 6/1974 | Simmons | 273/167 J |
| 3,993,314 | 11/1976 | Harrington | 273/170 |
| 4,021,047 | 5/1977 | Mader . | |
| 4,156,526 | 5/1979 | Huggins et al. . | |
| 4,655,458 | 4/1987 | Lewandowski . | |
| 5,064,197 | 11/1991 | Eddy . | |
| 5,178,392 | 1/1993 | Santioni | 273/167 H |
| 5,263,713 | 11/1993 | Taylor et al. . | |
| 5,328,175 | 7/1994 | Yamada . | |
| 5,346,216 | 9/1994 | Aizawa . | |
| 5,410,798 | 5/1995 | Lo | 273/167 H |
| 5,540,625 | 7/1996 | Koch | 473/318 |

FOREIGN PATENT DOCUMENTS

| | | | |
|---|---|---|---|
| 24274 | of 1899 | United Kingdom | 273/78 |
| 124401 | 5/1945 | United Kingdom | 273/78 |
| 2247628 | 3/1992 | United Kingdom . | |

*Primary Examiner*—Sebastiano Passaniti
*Attorney, Agent, or Firm*—Peter D. Keefe

[57] ABSTRACT

A golf club providing the golfer control over internal pressure therewithin to thereby most advantageously fine-tune the performance of the golfer's golf club. The selectively pressurized golf club is composed of either a hollow head, a hollow shaft, or both hollow head and hollow shaft, either or both of which being selectively pressurized, separately or as one, either above or below atmospheric pressure. In the preferred embodiment, the gas pressure within the golf club is selectively accessed by the golfer via a valve mounted thereto, such as for example a pneumatic valve or an elastomeric valve. The head may have its own valve and its separate pressurizable internal chamber; the shaft may have its own valve and separate pressurizable internal chamber; or one valve may be present for selectively changing pressurization within fluidically communicating shaft and head internal chambers.

17 Claims, 2 Drawing Sheets

16
14
18
12
38
24a
40

28
30
26
24a
32
12

10
16
2
2
12
14
18
20

5
24
38
42
22
5
24a
24
16a
42
38
50
48
44
22
30

24
16a
56
54
56
24b
44
22'
30
16

GOLF CLUB HAVING SELECTIVELY ADJUSTABLE INTERNAL PRESSURE

BACKGROUND OF THE INVENTION

1. Field of the Invention

The present invention relates to golf clubs, and more particularly to hollow golf clubs. Still more particularly, the present invention relates to a hollow golf club wherein the head, the shaft, or the head and the shaft thereof is selectively pressurized either above or below atmospheric pressure.

2. Description of the Related Art

Golf clubs are conventionally composed of a head having a face for striking a golf ball and a shaft connected with the head at a neck of the head. The shaft includes a grip for the golfer to adeptly hold and adroitly swing the golf club to thereby strike the golf ball during a game of golf. The shaft is usually in the form of a hollow rod and is constructed of metal, although other materials and constructions can be used. The head has conventionally three basic forms: a "wood" which has usually a metallic construction with a more-or-less bulbous configuration and a large area face; an "iron" which has a thin metallic construction and a large area face; and a "putter" which has a thin metallic construction and a small area face. Golf club heads have face shapes, face surface contours and face angles (relative to the shaft) which provide selected ball striking features that are of particular utility depending upon the golfer's play situation as the game unfolds. Accordingly, a golfer typically has a set of golf clubs having a variety of head types.

Golfers are eternally trying to perfect their game, whereby the least number of strokes are expended to complete a round of golf. While a golfer's score may partly be dependent upon skill and luck, the quality of the golf clubs used are crucial to a low score. Over the years, many golf club designs have been forwarded which claim to improve a golfer's score simply on the basis of improved equipment.

One type of golf club concept that has been forwarded is to place a pressurized fluid into the head in order to improve the golfer's score, as follows. U.S. Pat. No. 5,263,713 to Taylor et al, dated Nov. 23, 1993, discloses a hollow golf club head having therein a pressurized silicon oil which is intended to increase the size of the "sweet spot" of the face and increase the drive range of a struck golf ball. The pressures disclosed are extremely high (the low pressure value disclosed being on the order of 5,000 pounds per square inch (psi) gauge, and the high pressure value disclosed being on the order of 30,000 psi). It is courteously submitted that this pressure range involves an excessive pressure which would seem to be inherently dangerous. United Kingdom Patent Application 2,247,628, published on Mar. 11, 1992, discloses a hollow head golf club having a pressurized gas therein, the gas pressure being set anywhere from 1 to 250 atmospheres (ie, from zero to 3,675 psi, wherein 1 atmosphere is defined as 14.7 psi absolute).

While the above two patents usefully describe pressurizing a golf club head to thereby effect an advantageous quality change thereto, they are silent as to other possibilities which may be effected to provide a more complete range of advantageous quality changes to the golf club by means of selective adjustment of pressure therewithin, by means of providing an internal pressure below atmospheric, and by means of selectively pressurizing the shaft.

SUMMARY OF THE INVENTION

The present invention is a golf club which affords the golfer control over internal pressure therewithin to thereby most advantageously fine-tune the performance of the golfer's golf club.

The selectively pressurized golf club according to the present invention is composed of either a hollow head, a hollow shaft, or both hollow head and hollow shaft, either or both of which being selectively pressurized, separately or as one, either above or below atmospheric pressure.

In the preferred embodiment, the gas pressure within the golf club is selectively accessed by the golfer via a valve mounted thereto, such as for example a pneumatic valve or an elastomeric valve. The head may have its own valve and its separate pressurizable internal chamber; the shaft may have its own valve and separate pressurizable internal chamber; or one valve may be present for selectively changing pressurization within fluidically communicating shaft and head internal chambers.

Accordingly, it is an object of the present invention to provide a golf club which may be selectively internally pressurized.

It is another object of the present invention to provide a golf club which may be selectively internally pressurized, either above or below atmospheric pressure.

It is a further object of the present invention to provide a golf club which may be selectively internally pressurized, either above or below atmospheric pressure, wherein either the head or the shaft thereof my be separately internally pressurized, or they may be jointly internally pressurized.

It is yet a further object of the present invention to provide a golf club which may be selectively internally pressurized, either above or below atmospheric pressure, wherein either the head or the shaft thereof my be separately internally pressurized, or they may be jointly internally pressurized, and further wherein the internal pressure may be selectively varied via one or more valves connected with the golf club.

These, and additional objects, advantages, features and benefits of the present invention will become apparent from the following specification.

DETAILED DESCRIPTION OF THE PREFERRED EMBODIMENT

Figures 1, 2, 3, 5, 6:
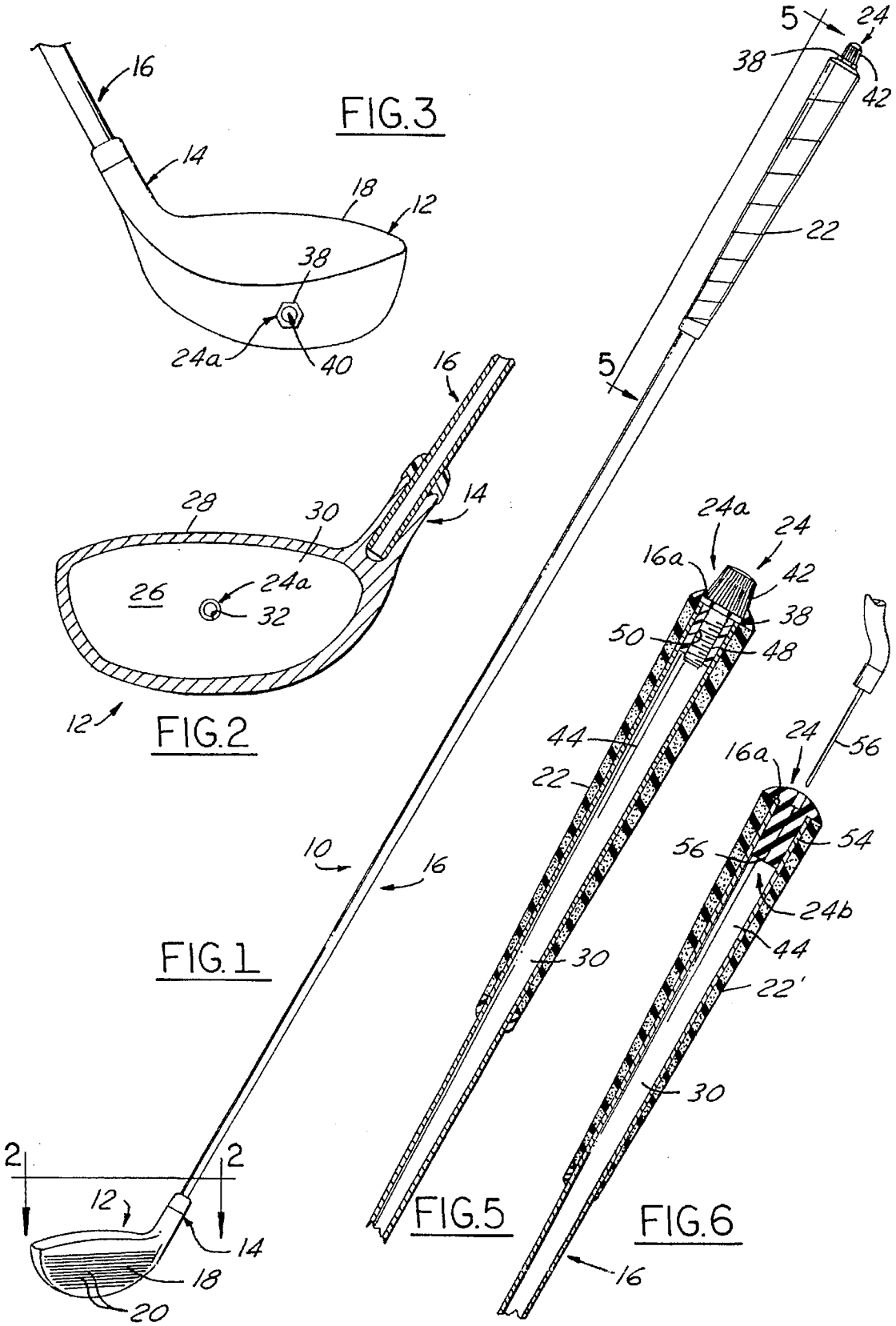
FIG. 1 is an elevational side view of a selectively pressurizable golf club according to the present invention.
FIG. 2 is a broken away, partly sectional view of a head of the selectively pressurizable golf club according to the present invention.
FIG. 3 is a broken away, rear side view of a head of a golf club according to the present invention.
FIG. 5 is a broken away, partly sectional side view of a shaft of the selectively pressurizable golf club according to the present invention, showing a first preferred form of valve connected therewith.
FIG. 6 is a broken away, partly sectional side view of a shaft of the selectively pressurizable golf club according to the present invention, showing a second preferred form of valve connected therewith.

Referring now to the Drawing, FIG. 1 generally depicts the selectively pressurizable golf club 10 according to the present invention. The selectively pressurizable golf club 10 includes a head 12, a neck 14 formed with the head, and a shaft 16 connected with the neck. The head 12 has a face 18 for strikingly interfacing with a golf ball. The face may be provided with any suitable contouring or configuration advantageous for striking a golf ball, such as for example conventional grooving 20. The shaft 16 is elongated and rod-like in shape, having a hand grip 22 located thereupon remote from the neck 14. In concert with the intendment of the present invention, the head 12 or the shaft 16, or the head and the shaft, singly or jointly, are provided with hollow space therewithin. The hollow space is air tight and may be selectively pressurized above or below atmospheric pressure. Advantageously, the internal pressure of the golf club 10 is user selectable via one or more valves 24 connected with the golf club and which communicates with the one or more hollow spaces.

While the preferred head 12 to be used with the present invention is a "wood" type, it is possible to provide a hollow space within other head types, such as for example the "iron" and "putter" types.

The structure and function of the selectively pressurizable golf club 10 will now be described with greater specificity, with reference being additionally directed to FIGS. 2 through 8.

FIG. 2 depicts a head chamber 26 located within the head 12, wherein the head chamber is sealed air tight. The hollow space formed by the head chamber 26 is defined by the body wall 28 of the head 12 (the body wall including the face 18). In this regard, the head chamber 26 and the face 18 must be configured so that positive or negative pressure of gas 30 within the head chamber will act upon the face so that the face is tensioned (positively or negatively) thereby. This feature is important in that one point of the invention is to provide an interaction between the golf club and the golf ball which is user selectable because of selectable pressurization within the head. For example, if the head chamber was located remote from the face or if the face was quite thick, then the characteristics of golf ball strikes would be almost unaffected by pressurizing the head chamber (positively or negatively relative to atmospheric pressure). Therefore, a head 12 according to the present invention would be preferably optimized with these considerations in mind.

The type of gas 30 present in the head chamber 26 is preferably air, but other pure or mixed gases can be used, such as for example, nitrogen, helium or carbon dioxide.

In order that the pressure of the gas 30 be user selectable, a valve 24 is connected with the body wall 28 of the head 12. The preferred valve 24 is a pneumatic valve **24*a* of the type used for pneumatic tire inflation via a delivery nozzle from a compressed air supply. Alternatively, another type of valve may be used, such as an elastomeric valve 24*b* (see FIG. 6**) of the type used for inflating toy balls via insertion thereinto by a proboscis.

Figures 4, 7, 8:
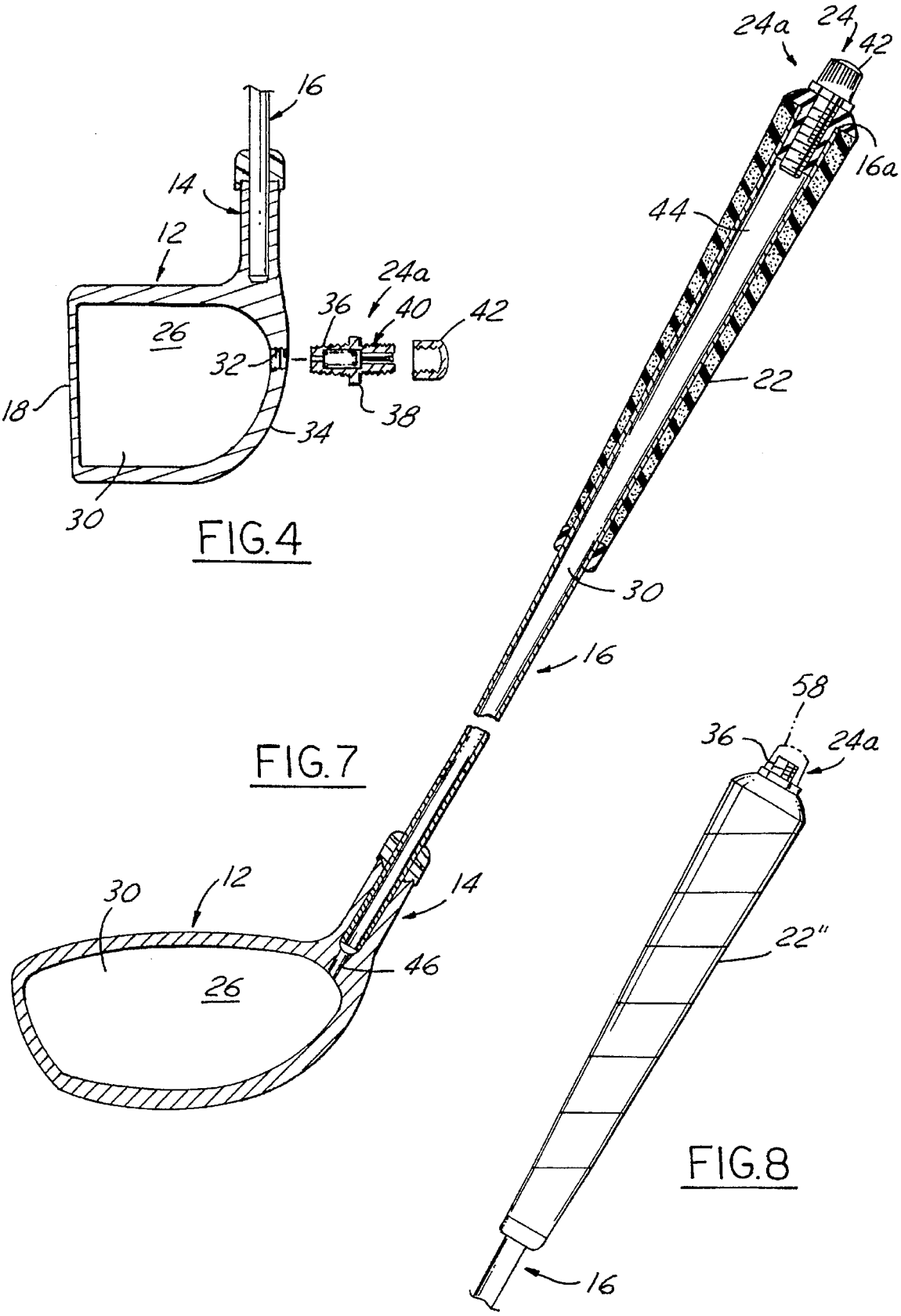
FIG. 4 is a broken away, partly sectional, exploded side view of the head of a golf club according to the present invention.
FIG. 7 is a partly broken away, partly sectional side view of the pressurizable golf club according to the present invention, showing the head and shaft having jointly communicating internal cavities.
FIG. 8 is a broken away side view of an alternative shaft construction of a golf club according to the present invention.

As shown best at FIG. 4, the pneumatic valve **24*a* is composed of a threaded valve body 36 having a hex head 38 for providing wrenched threading the valve body into a threaded hole 32 through the body wall 28 in an air tight sealed relation with respect thereto. In this regard, a conventional thread sealant may be advantageously utilized at the thread interface. Within the valve body 36 of the pneumatic valve 24*a* is a conventional spring biased pneumatic valve mechanism 40 for use with conventional compressed air delivery nozzles as are common to automotive service stations for inflating pneumatic tires. The preferred location of the pneumatic valve 24*a* is opposite the face 18, at the rear side 34 of the body wall 28, since at this position, the protruding portion of the valve body will not distract the golfer's swing concentration and will be protected from divot impacting. A threaded cap 42 protects the pneumatic valve mechanism 40. It will be noticed that a minimal amount of the body 36 protrudes from the body wall 28 at the hex nut 38 sufficient so that a conventional gas delivery nozzle can operably interface with the valve mechanism 40 to thereby communicate with the head chamber 26**.

In operation, the user unscrews the protective cap 42 of the pneumatic valve **24*a*, then inserts a gas delivery nozzle of a gas pressure source which provides a gas under pressure which may be above atmospheric pressure (ie., a positively pressured gas) or may be below atmospheric pressure (ie., a negatively pressurized gas, that is, a gas under partial vacuum) to the pneumatic valve in a conventional manner. The pressure of the gas 30 within the head chamber 26** is then either selected to be below or above atmospheric pressure, typically from about −7 psi gauge (7.7 pounds per square inch absolute) to about 120 psi gauge (124.7 pounds per square inch absolute), but lower or higher pressures are possible.

With respect to a gas in the head chamber 26 being negatively pressurized (ie., below atmospheric pressure) or positively pressurized (ie., above atmospheric pressure), the elastic response of the face to impact with a golf ball is adjustable based upon selection of internal pressure, to thereby provide an optimum addressment to the golf ball that improves the golfer's game. Further, with respect to negative internal pressure, it is believed that the face 18 will be negatively tensioned in the same direction as a golf ball striking the face, thus reducing face distortion and elastic losses when the face strikes a golf ball and thereby improving ball direction control and ball flight distance as compared with a face having a gas that is non-pressurized (ie., at atmospheric pressure) or positively pressurized (ie., above atmospheric pressure) in the head chamber 26.

FIGS. 5 through 7 depict a shaft 16 having a hollow space in the form of a shaft chamber 44. In this regard, the shaft 16 is structured as a tapering hollow metallic cylinder, having its narrowest cross-section at the neck. The shaft 16 connects fixedly to a head at the neck 14 thereof. The shaft chamber 44 is either separately sealed at the neck 14 from the head, whether or not the head has a head chamber, or else, as shown in FIG. 7, the shaft chamber fluidically communicates with the head chamber 26 through a passage 46 provided in the head body 28 at the neck 14. The valve 24 for the shaft chamber 44 is provided at the distal end **16*a* of the shaft 16**.

As shown in FIGS. 5 and 7, in the case of a pneumatic valve **24*a*, a plastic or metallic plug 48 is fixedly seated within the shaft 16 at the distal end 16*a* thereof, such as by an adhesive. The plug 48 has a threaded hole 50 into which the valve body 36 threads, as discussed hereinabove relative to the head 12. The hand grip 22 of the shaft fits around the protruding valve body, as generally shown in FIG. 5**.

As shown in FIG. 6, in the case of an elastomeric valve **24*b*, an elastomer valve member 54 is fixedly secured into the shaft 16 at the distal end 16*a* thereof, such as by an adhesive. The elastomeric valve member 54 has a self-sealing passage 56 therein which is normally elastically sealed closed unless acted upon by the conventional proboscis 56 of a source 58 of selectively pressured gas 30'. The hand grip 22' of the shaft abuts the elastomeric valve body 54, as generally shown in FIG. 6**.

As shown in FIG. 8, it is possible to cover the pneumatic valve 24 at the distal end 16*a* of the shaft 16 with a slip-on, press-fit grip cap 58 which cleanly abuts the hand grip 22" so that the presence of a valve will not be revealed to onlookers.

In operation, the user performs the steps above for selectively pressurizing the head 12, if the head has a head chamber. The user then unscrews the valve cap 42 if it is present or removes the grip cap 58 if it is present. Then the user connects a source of selective gas pressure to the valve 24 to thereby pressurize the gas 30' within the shaft chamber 44 either above or below atmospheric pressure, typically from about −7 psi gauge (7.7 pounds per square inch absolute) to about 120 psi gauge (124.7 pounds per square inch absolute), but lower or higher pressures are possible.

With respect to a gas in the shaft chamber 44 being positively or negatively pressurized, it is believed that the rigidity of the shaft can be adjusted by selecting an appropriate internal pressure, and further the vibrational characteristics of the shaft when the head strikes a golf ball can also be adjusted by selecting an appropriate internal pressure, thereby enhancing the golfer's control over his or her game.

In the case of fluidically communicating head and shaft chambers, only a valve 24 at either the head or at the shaft need be provided to simultaneously selectively pressurize the gas 30 in both the head and shaft chambers to any desired pressure below or above atmospheric pressure, typically from about −7 psi gauge (7.7 pounds per square inch absolute) to about 120 psi gauge (124.7 pounds per square inch absolute), but lower or higher pressures are possible.

The term "atmospheric pressure" as used herein generally means standard atmospheric pressure at sea level (that is, zero psi equals 14.7 pounds per square inch absolute); alternatively, "atmospheric pressure" as used herein generally means local atmospheric pressure (as affected by weather and altitude) at a particular time of measurement.

To those swilled in the art to which this invention appertains, the above described preferred embodiment may be subject to change or modification. Such change or modification can be carried out without departing from the scope of the invention, which is intended to be limited only by the scope of the appended claims.

What is claimed is:

1. A golf club having selectively adjustable internal pressure, comprising:

a head having a face and a neck, said head having a head chamber that provides an aim tight hollow space therewithin;

a shaft connected with said neck, said shaft having a distal end opposite said neck; and valve means for providing connection of a source of selectively pressurized gas to said head chamber to thereby provide a gas having a selected internal pressure below atmospheric pressure in said head chamber which thereby provides negative tensioning of said face.

2. The golf club of claim 1, wherein said selected internal pressure is a pressure of substantially between −7 psi and −1 psi gauge.

3. The golf club of claim 2, wherein said head has a body wall, said body wall having a threaded hole therethrough; wherein said valve means comprises a pneumatic valve threadably engaged with said hole in an air tight sealed relation with respect thereto.

4. The golf club of claim 3, wherein said hole is located at a portion of said body wall that is opposite said face.

5. The golf club of claim 1, further comprising:

a shaft chamber that provides an air tight hollow space within said shaft, said shaft chamber extending substantially between said neck and said distal end; and passage means located at said neck for providing fluidic communication between said head chamber and said shaft chamber;

wherein said selected internal pressure in said head chamber via said valve means is simultaneously provided in said shaft chamber via said passage means.

6. A golf club having selectively adjustable internal pressure, comprising:

a head having a face and a neck;

a shaft connected with said neck, said shaft having a distal end opposite said neck, said shaft having a shaft chamber that provides an air tight hollow space therewithin, said shaft chamber extending substantially between said neck and said distal end; and valve means for providing connection of a source of selectively pressurized gas to said shaft chamber to thereby provide a gas having a selected internal pressure below atmospheric pressure in said shaft chamber.

7. The golf club of claim 6, wherein said selected internal pressure is a pressure within a range defined by at least one of substantially between −7 psi and −1 psi gauge.

8. The golf club of claim 6, wherein said valve means is located at said distal end.

9. The golf club of claim 6, wherein said valve means is a pneumatic valve sealingly seated at said distal end.

10. The golf club of claim 8, wherein said valve means comprises an elastomeric valve sealingly seated at said distal end.

11. The golf club of claim 6, further comprising:

a head chamber that provides an air tight hollow space therewithin; and passage means located at said neck for providing fluidic communication between said head chamber and said shaft chamber;

wherein said selected internal pressure in said shaft chamber via said valve means is simultaneously provided in said head chamber via said passage means.

12. A golf club having selectively adjustable internal pressure, comprising:

a head having a face and a neck, said head having a head chamber that provides an air tight hollow space within said head;

a shaft connected with said neck, said shaft having a distal end opposite said neck, said shaft having a shaft chamber that provides an air tight hollow space within said shaft, said shaft chamber extending substantially between said neck and said distal end;

plug means for providing an air tight seal between said head chamber and said shaft chamber so that said head chamber is fluidically isolated from said shaft chamber;

first valve means for providing connection of a source of selectively pressurized gas to said shaft chamber to thereby provide a first gas having a first selected internal pressure in said shaft chamber; and second valve means for providing connection of a source of selectively pressurized gas to said head chamber to thereby provide a second gas having a second selected internal pressure in said head chamber.

13. The golf club of claim 12, wherein each said first and second selected internal pressure is less than atmospheric pressure.

14. The golf club of claim 12, wherein said selected internal pressure is a pressure within a range defined by at least one of substantially between −7 psi and 120 psi gauge and substantially between 7.7 psi and 124.7 psi absolute.

15. The golf club of claim 14, wherein said first valve means is located at said distal end.

16. The golf club of claim 15, wherein said first and second valve means are selected from at least one of a pneumatic valve and an elastomeric valve.

17. A golf club comprising:

a head having a face and a neck, said head having a head chamber that provides an air tight hollow space therewithin, said head chamber having a gas therein having a pressure below atmospheric pressure which thereby provides negative tensioning of said face; and a shaft connected with said neck, said shaft having a distal end opposite said neck.

* * * * *